US006768454B2

(12) United States Patent
Kingsley et al.

(10) Patent No.: US 6,768,454 B2
(45) Date of Patent: Jul. 27, 2004

(54) DIELECTRIC RESONATOR ANTENNA ARRAY WITH STEERABLE ELEMENTS

(75) Inventors: Simon P. Kingsley, Sheffield (GB); Steven G. O'Keefe, Chambers Flat (AU)

(73) Assignee: antenova Limited (GB)

( * ) Notice: Subject to any disclaimer, the term of this patent is extended or adjusted under 35 U.S.C. 154(b) by 0 days.

(21) Appl. No.: 10/221,467

(22) PCT Filed: Mar. 8, 2001

(86) PCT No.: PCT/GB01/00997

§ 371 (c)(1),
(2), (4) Date: Dec. 19, 2002

(87) PCT Pub. No.: WO01/69722

PCT Pub. Date: Sep. 20, 2001

(65) Prior Publication Data

US 2003/0151548 A1 Aug. 14, 2003

(30) Foreign Application Priority Data

Mar. 11, 2000 (GB) ..... 0005766
Mar. 27, 2000 (GB) ..... 0007366

(51) Int. Cl.[7] ..... H01Q 3/22
(52) U.S. Cl. ..... 342/368; 342/372
(58) Field of Search ..... 342/81, 154, 368, 342/372, 373

(56) References Cited

U.S. PATENT DOCUMENTS 5,872,547 A 2/1999 Martek
5,909,191 A * 6/1999 Hirshfield et al. ..... 342/174

FOREIGN PATENT DOCUMENTS

EP 0766443 11/1998
EP 0877443 A3 8/1999
GB 2268626 1/1994

OTHER PUBLICATIONS

"Low Profile Phased Array of Dielectric Resonator Antennas" by Petosa et al., IEEE Antennas and Propagation Society, International Symposium 1996, pp. 182–185.
"Bandwidth Enhancement of Dielectric Resonator Antennas" by Lee et al., IEEE Antennas and Propagation Society, International Symposium 1993, pp. 1500–1503.
"Beam Steering and Monopulse Processing of Probe–Fed Dielectric Resonator Antennas" by Kingsley et al., IEEE Proc–Radar, Sonar Navig., vol. 146, No. 3, Jun. 1999, pp 121–125.
"Two–Dimensional Cylindrical Dielectric Resonator Antenna Array" by Lueng et al., Electronics Letters, 25$^{th}$ Jun. 1998, vol. 34, No. 13, pp. 1283–1285.
"Active Phased Array of Dielectric Resonator Antennas" by Petosa et al., IEEE Antennas and Propagation Society International Symposium, US, New York, NY: IEEE, Jul. 14, 1997, pp. 690–693.

* cited by examiner

*Primary Examiner*—Dao Phan
(74) *Attorney, Agent, or Firm*—Sheridan Ross P.C.

(57) ABSTRACT

An array of dielectric resonator antenna elements (1), each element (1) being composed of a dielectric resonator disposed on a grounded substrate (3), a plurality of feeds (2) for transferring energy into and from the dielectric resonator elements (1), wherein the feeds (2) of each element (1) are activatable either individually or in combination so as to produce at least one incrementally or continuously steerable beam which may be steered through a predetermined angle. Both the element beam patterns generated by the individual elements (1) and the array factor generated by the array as a whole may be independently steered. When these are steered in synchronism, it is possible to improve the overall gain of the array in any particular direction.

59 Claims, 9 Drawing Sheets

DIELECTRIC RESONATOR ANTENNA ARRAY WITH STEERABLE ELEMENTS

The present invention relates to arrays of dielectric resonator antennas (DRAs) in which the patterns of the individual DRA elements may be electronically steered in synchronism with the array pattern.

Since the first systematic study of dielectric resonator antennas (DRAs) in 1983 [LONG, S. A., McALLISTER, M. W., and SHEN, L. C.: "The Resonant Cylindrical Dielectric Cavity Antenna", IEEE Transactions on Antennas and Propagation, AP-31, 1983, pp 406–412], interest has grown in their radiation patterns because of their high radiation efficiency, good match to most commonly used transmission lines and small physical size [MONGIA, R. K. and BHARTIA, P.: "Dielectric Resonator Antennas—A Review and General Design Relations for Resonant Frequency and Bandwidth", International Journal of Microwave and Millimetre-Wave Computer-Aided Engineering, 1994, 4, (3), pp 230–247].

The majority of configurations reported to date have used a slab of dielectric material mounted on a ground plane excited by either an single aperture feed in the ground plane [ITTIPIBOON, A. MONGIA, R. K., ANTAR, Y. M. M., BHARTIA, P. and CUHACI, M: "Aperture Fed Rectangular and Triangular Dielectric Resonators for use as Magnetic Dipole Antennas", Electronics Letters, 1993, 29, (23), pp 2001–2002] or by a single probe inserted into the dielectric material [McALLISTER, M. W., LONG, S. A. and CONWAY G. L.: "Rectangular Dielectric Resonator Antenna", Electronics Letters, 1983, 19, (6), pp 218–219]. Direct excitation by a transmission line has also been reported by some authors [KRANENBURG, R. A. and LONG, S. A.: "Microstrip Transmission Line Excitation of Dielectric Resonator Antennas", Electronics Letters, 1994, 24, (18), pp 1156–1157].

The concept of using a series of these single feed DRAs to build an antenna array has already been explored. For example, an array of two cylindrical single-feed DRAs has been demonstrated [CHOW, K. Y., LEUNG. K. W., LUK, K. M. AND YUNG, E. K. N.: "Cylindrical dielectric resonator antenna array", Electronics Letters, 1995, 31, (18), pp 1536–1537] and then extended to a square matrix of four DRAs [LEUNG, K. W., LO, H. Y., LUK, K. M. AND YUNG, E. K. N.: "Two-dimensional cylindrical dielectric resonator antenna array", Electronics Letters, 1998, 34, (13), pp 1283–1285]. A square matrix of four cross DRAs has also been investigated [PETOSA, A., ITTIPIBOON, A. AND CUHACI. M.: "Array of circular-polarized cross dielectric resonator antennas", Electronics Letters, 1996, 32, (19), pp 742–1743]. Long linear arrays of single-feed DRAs have also been investigated with feeding by either a dielectric waveguide [BIRAND, M. T. AND GELSTHORPE, R. V.: "Experimental millimetric array using dielectric radiators fed by means of dielectric waveguide", Electronics Letters, 1983, 17, (18), pp 633–635] or a microstrip [PETOSA. A., MONGIA, R. K., ITTIPIBOON, A. AND WIGHT, J. S.: "Design of microstrip-fed series array of dielectric resonator antennas", Electronics Letters, 1995, 31, (16), pp 1306–1307]. This last research group have also found a method of improving the bandwidth of microstrip-fed DRA arrays [PETOSA, A., ITTIPIBOON, A., CUHACI, M. AND LAROSE, R.: "Bandwidth improvement for microstrip-fed series array of dielectric resonator antennas", Electronics Letters, 1996, 32, (7), pp 608–609]. It is important to note that none of these publications have discussed the concept of multi-feed DRAs or the concept of array element steering.

Earlier work by the present inventors [KINGSLEY, S. P. and O'KEEFE, S. G., "Beam Steering and Monopulse Processing of Probe-Fed Dielectric Resonator Antennas", IEE Proceedings—Radar, Sonar and Navigation, 146, 3, 121–125, 1999] shows how several spatially separated feeds can be used to drive a single circular slab of dielectric material so as to produce an antenna with several beams facing in different directions. The simultaneous excitation of several feeds means that the DRA can have electronic beamsteering and direction finding capabilities. This work is also disclosed in the present applicants U.S. patent application Ser. No. 09/431,548 entitled "Steerable-beam multiple-feed dielectric resonator antenna", the disclosure of which is incorporated into the present application by reference.

The present application extends the previous work of Kingsley and O'Keefe by considering the properties and benefits of arrays composed of many such multi-feed DRAs. A wide range of array geometries is considered.

An antenna array is a collection of (often evenly spaced) simple elements such as monopoles, dipoles, patches, etc. The arrangement of elements to form the array may be linear, 2-D, in a circle, etc. and the shape of 2-D arrays may be rectangular, circular, oval, etc. In an array, each individual element has a broad radiation pattern but when they are combined together, the array as a whole has a much narrower radiation pattern. More importantly, by feeding the elements with different phases or time delays, the array pattern can be steered electronically. This is a most useful facility in radar and communications.

It is important to distinguish between the various radiation patterns referred to in the present application. Firstly, each element of the array has its own notional radiation pattern when considered in isolation. This element pattern may be considered to be analogous to the diffraction pattern of one of the light sources in a Young's slits interference demonstration. Secondly, the array as a whole has a notional radiation pattern, known as the array factor, which is the sum of the idealised isotropic element patterns, and which may be considered to be analogous to the interference pattern in a Young's slits demonstration. Finally, the actual radiation pattern formed by the antenna array, known as the antenna pattern, is the product of the element patterns and the array factor. Each of the element pattern, array factor and antenna pattern may be considered to have a direction in which transmission/reception has a maximum gain, and embodiments of the present invention seek to steer these directions in useful ways.

The radiation patterns of the individual elements of an array are fixed so that when the array factor faces straight ahead (on boresight), the resultant antenna pattern has the benefit of the full gain of each individual element. In fact, the gain of the array is the sum of the gain of the elements. However, when the array factor is steered off boresight, the gain can fall because the array factor is moving outside the pattern of the individual elements. The only time this is not true is when the elements are omnidirectional in the plane of the array (such as monopoles), but as these are usually low gain elements there still remains a problem of low gain overall.

Embodiments of the present invention seek to provide an array of dielectric resonator antenna elements, where each element has several energy feeds connected in such a way that the radiation pattern of each element can be steered. One method of electronically steering an antenna element pattern is to have a number of existing beams and to switch between them or, alternatively, to combine them so as to achieve the desired beam direction. The general concept of deploying a plurality of probes within a single dielectric resonator antenna, as pertaining to a cylindrical geometry, is described in the paper KINGSLEY, S. P. and O'KEEFE, S. G., "Beam Steering and Monopulse Processing of Probe-Fed Dielectric Resonator Antennas", IEE Proceedings—Radar, Sonar and Navigation, 146, 3, 121–125, 1999, the disclosure of which is incorporated into the present application by reference.

It has been noted by the present applicants that the results described in the above reference apply equally to DRAs operating at any of a wide range of frequencies, for example from 1 MHz to 100,000 MHz and even higher for optical DRAs. The higher the frequency in question, the smaller the size of the DRA, but the general beam patterns achieved by the probe/aperture geometries described hereinafter remain generally the same throughout any given frequency range. Operation at frequencies substantially below 1 MHz is also possible, using dielectric materials with a high dielectric constant.

According to the present invention, there is provided an array of dielectric resonator antenna elements, each element being composed of at least one dielectric resonator and a plurality of feeds for transferring energy into and from the elements, wherein the feeds of each element are activatable either individually or in combination so as to produce at least one incrementally or continuously steerable element beam which may be steered through a predetermined angle, characterised in that, during operation of the array, the feeds of the elements are activated such that the element beams from the different elements are steered in synchrony with each other, and in that the element beams, when combined, interact so as to form at least one array beam which is steered in synchrony with the element beams.

The array may be provided with electronic circuitry adapted to activate the feeds either individually or in combination so as to produce at least one incrementally or continuously steerable beam which may be steered through a predetermined angle.

The array may additionally be provided with further electronic circuitry adapted to activate each of the antenna elements with a pre-determined phase shift or time delay so as to generate an array factor which may be steered through a predetermined angle. For example, for a given array factor direction (which here is the same as the antenna beam direction), each element may be fed with a different phase or time delay (and, in practice, a different amplitude) so that when the element patterns are added together, they give rise to an antenna pattern in a predetermined direction. For a different antenna beam direction, the phases and amplitudes of the element feeds will be different.

By providing an array of steerable DRAs, the present invention seeks to enable the individual element patterns to be steered in synchronism with the array factor as a whole, thereby forming an array having maximum or at least improved element gain for a given array factor direction.

The elements of the array may be arranged in a substantially linear formation, and may be arranged side by side so as to provide azimuth beamsteering or one on top of the other so as to provide elevation as well as azimuth beamsteering. The elements may or may not be evenly spaced, depending on requirements, and the linear array may be arranged so as to be conformal to a curved or distorted surface. This latter feature has potentially important implications in, for example, communications on aircraft. For example, by conforming a linear array of elements to the fuselage of an aircraft and by arranging for the element beam patterns all to face the same way regardless of the actual orientation of the elements on the fuselage, it is possible to match an array beam pattern with the element beam pattern so as to improve gain. Furthermore, a dielectric lens may be provided so as to improve control of azimuth and/or elevation beamsteering.

Alternatively, the elements of the array may be disposed in a ring-like formation, such as a circle, or may be disposed more generally in at least two dimensions across a surface. The elements may or may not be evenly spaced, and may, for example, be in the form of a regular lattice. As discussed above, the surface in which the elements are disposed may be conformed to a curved or distorted surface, such as the fuselage of an aircraft, and the elements may be individually controlled so that the element beam patterns all face the same way regardless of the individual physical orientations of the elements themselves. Furthermore, a dielectric lens may be provided so as to improve control of azimuth and/or elevation beamsteering Alternatively, the elements of the array may be arranged as a three dimensional volumetric array, the array as a whole having an outer envelope in the form of a regular solid (e.g. sphere, tetrahedron, cube, octahedron, icosahedron or dodecahedron) or an irregular solid. The elements may or may not be evenly spaced, and may, for example, be in the form of a regular lattice. The volumetric array may be formed as a combination of linear and/or surface arrays stacked one on top of the other so as to allow both azimuth and elevation beamsteering. Furthermore, a dielectric lens may be provided so as to improve control of azimuth and/or elevation beamsteering.

Beamsteering in elevation is achieved by stacking the DRA elements on top of each other, or by forming a stack of DRA arrays, and by energising the elements appropriately. For example, in a vertical stack of cylindrical multi-probe elements, each element on its own can steer an element beam in azimuth, and it is possible to feed the probes so that all of the elements form element beams which face in the same direction. When combined, these element beams form a horizontal beam in the chosen direction which is smaller in elevation than the elevation pattern of a single element. By changing the phasing, for example, between the element feeds, it is possible to move the combined beam up and down in elevation. In a more complex system, there may be provided a vertical stack of linear element arrays.

Advantageously, the antenna array as a whole is adapted to produce at least one incrementally or continuously steerable beam, which may be steered through a complete 360 degree circle.

Advantageously, each individual element of the antenna array is also adapted to produce at least one incrementally or continuously steerable beam, which may be steered through a complete 360 degree circle.

Advantageously, there is additionally or alternatively provided electronic circuitry to combine the feeds of each individual element of the antenna array such that the element pattern is steered in angle in synchronism with the antenna array pattern.

Advantageously, there is additionally or alternatively provided electronic circuitry to provide at least two feeds to each individual element of the antenna array such that, when the array is used to form at least two array factors simultaneously, the elements are activatable so as to form at least two element beams simultaneously which are steerable in synchronism with the antenna pattern (which is the sum of the at least two array factors).

Generally, the at least two array factors together form an antenna pattern having two main lobes.

When a conventional antenna array is used to form at least two beams simultaneously, then at least two sets of phases and amplitudes for the elements must be combined by driving each element through one (or more) power splitter/combiners which are large, lossy devices. Embodiments of the present invention can achieve the same result by simply connecting one set of phases and amplitudes to one particular feed to each DRA element and another set of phases and amplitudes up a different feed to each element.

The feed to each element may include a cable, fibre optic connection, printed circuit track or any other transmission line technique, and these may be of predetermined different effective lengths so as to insert different time delays in the feed to each element, thus providing beamsteering control. The delays may be controlled and varied by controlling and varying the effective lengths of the transmission lines, either electrically, electronically or mechanically, for example by switching additional lengths of transmission line in and out of the base transmission lines.

Alternatively or in addition, beamsteering may be effected by individually adjusting the phase of the feed to each element, for example by including diode phase shifters, ferrite phase shifters or other types of phase shifters into the transmission lines. Additional control may be achieved by varying the amplitude of signals in the transmission lines, for example by including attenuators therein.

The feed mechanisms to the elements may incorporate a resistive beamforming matrix of phase shifters so as to insert different phase delays in the feed to each element. Alternatively or in addition, the feed mechanisms to the elements may incorporate a matrix of hybrids, such as a Butler matrix, so as to form a plurality of beams from a plurality of elements. A Butler matrix is a parallel RF beam-forming network that forms N contiguous beams from an N-element array. The network makes use of directional couplers, fixed phase differences and transmission lines. It is lossless apart from the insertion loss of these components. Other types of RF beamforming networks also exist.

Alternatively or in addition, "weighting" or "window" function may be applied electronically or otherwise to the feeds to the elements so as to control array factor sidelobes. Exciting all elements equally gives a uniform aperture distribution that results in high array factor sidelobe levels. Applying a window function, such that the elements towards the edge of the array contribute less to the array factor than those at the centre, can reduce these sidelobe levels.

Alternatively or in addition, an "error" or "correction" function may be applied electronically or otherwise to the feeds of the elements so as to control embedded element, mutual coupling, surface wave and other perturbing effects. Simple array theory assumes that all the elements behave identically. However, those disposed toward the edge of an array may behave differently to those nearer the centre, because of the reasons given above. For example, an element at the centre experiences mutual coupling to the elements either side, but an element at the edge has no neighbour on one side. These error effects can be measured and corrected for by applying a correction factor.

Each element of the array may be connected to a single beamforming mechanism so as to produce a single array factor, or to a plurality of beamforming mechanisms so as simultaneously to produce a plurality of array factors.

The elements of the array may be disposed so as to permit various polarisations to be achieved, such as vertical, horizontal, circular or any other polarisation, including switchable or otherwise controllable polarisations. For example, MONGIA, R. K., ITTIPIBOON, A., CUHACI, M. and ROSCOE D.: "Circular Polarised Dielectric Resonator Antenna", Electronics Letters, 1994, 30, (17), pp 1361–1362; and DROSSOS, G., WU, Z. and DAVIS, L. E.: "Circular Polarised Cylindrical Dielectric Resonator Antenna", Electronics Letters, 1996, 32, (4), pp 281–283.3, 4, the disclosures of which are incorporated into the present application by reference, describe how two probes fed simultaneously in a circular cross-section dielectric slab and installed on radials at 90° to each other can create circular polarisation when fed in anti-phase. Furthermore, DROSSOS, G., WU, Z. and DAVIS. L. E.: "Switchable Cylindrical Dielectric Resonator Antenna", Electronics Letters, 1996, 32, (10), pp 862–864, the disclosure of which is also incorporated into the present application by reference, describes how polarisation may be achieved by switching the probes on and off.

Advantageously, there is additionally or alternatively provided electronic circuitry or computer software such that when digital beamforming techniques are used, the feeds of each individual element of the antenna array are controlled in such a way that the element pattern is steered in angle in synchronism with the array factor.

When each element of the array is connected to a separate transmitter module, a separate receiver module or a separate transmitter/receiver module, then digital beamforming techniques may be used to form steerable array factors of any desired shape which are steerable both in azimuth as well as in elevation.

With a conventional array (analogue beamsteering), a single transmitter or receiver is distributed to each element with the appropriate phase and amplitude modifications along each path. With digital beamforming, each element has its own transmitter or receiver and is instructed by a computer to form the appropriate phase and amplitude settings. In the receiving case, each receiver has its own A/D converter, the outputs of which can be used to form almost any desired beam shape, many different beams simultaneously, or even be stored in the computer and the beams formed some time later.

Many such array factors may be formed simultaneously by digital beamforming techniques through appropriate electronic or software control. Such array factors may contain one or more nulls in order to cancel interference, multipath or other unwanted signals in given directions. Alternatively, the DRA element pattern may be arranged so as to cancel some or all of the unwanted signals. For example, where a digital beamforming array has N elements then it generally has N−1 degrees of freedom, and so may be able to null out jamming signals from N−1 different directions. In embodiments of the present invention, each DRA element may also have at least one null in its radiation pattern, and this may be used to null out jamming signals from at least one additional direction. Digitally beamformed array patterns may be formed on-line in real time or, in the case of recorded received data, off-line at a later time.

Preferably, the array pattern steering and the synchronous element pattern steering is carried out through a complete 360 degree circle.

In one embodiment of the present invention, the dielectric resonator elements may be divided into segments by conducting walls provided therein, as described, for example, in U.S. Ser. No. 09/431,548 and in more detail in the present applicant's co-pending UK patent application no 0005766.1 filed on $11^{th}$ Mar. 2000 and International patent application no PCT/GB01/00929, filed on $2^{nd}$ Mar. 2001, both entitled "Multi-segmented dielectric resonator antenna", the full disclosures of which are incorporated into the present application by reference.

In a further embodiment of the present invention, there may additionally be provided at least one internal or external monopole antenna or any other antenna possessing a circularly symmetrical pattern about a longitudinal axis, which is combined with at least one of the dielectric resonator antenna elements so as to cancel out backlobe fields or to resolve any front-to-back ambiguity which may occur with a dielectric resonator antenna having a cosine or figure-of-eight radiation pattern. The monopole or other circularly symmetrical antenna may be centrally disposed within the dielectric resonator element or may be mounted thereupon or therebelow and is activatable by the electronic circuitry. In embodiments including an annular resonator with a hollow centre, the monopole or other circularly symmetrical antenna may be located within the hollow centre. A "virtual" monopole may also be formed by an electrical or algorithmic combination of any of the actual feeds, preferably a symmetrical set of feeds.

The dielectric elements or the dielectric resonators making up the elements may be formed of any suitable dielectric material, or a combination of different dielectric materials, having an overall positive dielectric constant k. Different elements or resonators may be made out of different materials having different dielectric constants k, or they may all be made out of the same material. Equally, the elements or resonators may all have the same physical shape or form, or may have different shapes or forms as appropriate. In preferred embodiments, k is at least 10 and may be at least 50 or even at least 100. k may even be very large e.g. greater than 1000, although available dielectric materials tend to limit such use to low frequencies. The dielectric material may include materials in liquid, solid, gaseous or plasma states, or any intermediate state. The dielectric material may be of lower dielectric constant than a surrounding material in which it is embedded.

The feeds may take the form of conductive probes which are contained within or placed against the dielectric resonators, or a combination thereof, or may comprise aperture feeds provided in a grounded substrate. Aperture feeds are discontinuities (generally rectangular in shape) in a grounded substrate underneath the dielectric material and are generally excited by passing a microstrip transmission line beneath them. The microstrip transmission line is usually printed on the underside of the substrate. Where the feeds take the form of probes, these may be generally elongate in form. Examples of useful probes include thin cylindrical wires which are generally parallel to a longitudinal axis of the dielectric resonator. Other probe shapes that might be used (and have been tested) include fat cylinders, non-circular cross sections, thin generally vertical plates and even thin generally vertical wires with conducting "hats" on top (like toadstools). Probes may also comprise metallised strips placed within or against the dielectric, or a combination thereof. In general, any conducting element within or against the dielectric resonator, or a combination thereof, will excite resonance if positioned, sized and fed correctly. The different probe shapes give rise to different bandwidths of resonance and may be disposed in various positions and orientations (at different distances along a radius from the centre and at different angles from the centre, as viewed from above) within or against the dielectric resonator or a combination thereof, so as to suit particular circumstances. Furthermore, there may be provided probes within or against the dielectric resonator, or a combination thereof, which are not connected to the electronic circuitry but instead take a passive role in influencing the transmit/receive characteristics of the dynamic resonator antenna, for example, by way of induction.

Generally, where the feed comprises a monopole feed, then the appropriate dielectric resonator element or dielectric resonator must be associated with a grounded substrate, for example by being disposed thereupon or separated therefrom by a small air gap or a layer of another dielectric material. Alternatively, where the feed comprises a dipole feed, then no grounded substrate is required. Embodiments of the present invention may use monopole feeds to dielectric elements or resonators associated with a grounded substrate, and/or dipole feeds to dielectric elements or resonators not having an associated grounded substrate. Both types of feed may be used in the same antenna.

Where a grounded substrate is provided, the dielectric resonators may be disposed directly on, next to or under the grounded substrate, or a small gap may be provided between the resonators and the grounded substrate. The gap may comprise an air gap, or may be filled with another dielectric material of solid, liquid or gaseous phase.

The antenna array of the present invention may be operated with a plurality of transmitters or receivers, the terms here being used to denote respectively a device acting as a source of electronic signals for transmission by way of the antenna array or a device acting to receive and process electronic signals communicated to the antenna array by way of electromagnetic radiation. The number of transmitters and/or receivers may or may not be equal to the number of elements being excited. For example, a separate transmitter and/or receiver may be connected to each element (i.e. one per element), or a single transmitter and/or receiver to a single element (i.e. a single transmitter and/or receiver is switched between elements). In a further example, a single transmitter and/or receiver may be (simultaneously) connected to a plurality of elements. By continuously varying the feed power between the elements, the beam and/or directional sensitivity of the antenna array may be continuously steered. A single transmitter and/or receiver may alternatively be connected to several non-adjacent elements. In yet another example, a single transmitter and/or receiver may be connected to several adjacent or non-adjacent elements in order to produce an increase in the generated or detected radiation pattern, or to allow the antenna array to radiate or receive in several directions simultaneously.

The array of elements may simply be surrounded by air or the like, or may be immersed in a dielectric medium having a permittivity between that of air and that of the elements themselves. In the latter case, the effective separation distance between the elements is reduced, and the dielectric medium can therefore be arranged to act as a dielectric lens. For example, if an array of any type is immersed in a dielectric medium having a relative permittivity $E_r$, then the size of the array can be reduced by $\sqrt{E_r}$.

By seeking to provide an antenna array composed of a plurality of dielectric resonator elements, each capable of generating multiple beams which can be selected separately or formed simultaneously and combined in different ways at will, embodiments of the present invention may provide the following advantages:

i) By choosing to drive different probes or apertures, the antenna array and each array element can be made to transmit or receive in one of a number of preselected directions (in azimuth, for example). This has the advantage that the gain of the array is always maximised by having maximum element gain. With a conventional antenna array (composed of dipoles, for example), as the array factor is steered away from the straight ahead 'boresight' position, the gain begins to fall because the array factor is steered outside the element pattern. A conventional array of dipoles, for example, cannot be steered through 360 degrees in the plane of the dipoles because at some point, usually at a steering angle of 90 degrees, the array factor falls into a null of the element pattern.

ii) By sequentially switching round the element feeds, and simultaneously switching round the array beam pattern, the resultant antenna radiation pattern can be made to rotate incrementally in angle. Such beam-steering has obvious applications for radio communications, radar and navigation systems.

iii) By combining two or more feeds simultaneously, element beams can be formed in any arbitrary azimuth direction to match an array factor formed in any arbitrary direction, thus giving more precise control over the beam-forming process whilst maintaining improved or maximum antenna gain.

iv) By electronically continuously varying the power division/combination of two or more feeds simultaneously, element beams can be steered continuously in synchronism with an array factor that is being steered continuously.

v) When at least two beams in different directions are formed simultaneously with the array, then the plurality of feeds in the antenna elements can be so disposed as to form more than one beam at once to match the array factor.

vi) The addition of an internal or external monopole antenna or other antenna possessing a circularly symmetrical radiation pattern about a longitudinal axis can be used to cancel or reduce a backlobe of the antenna array, thereby resolving any front-to-back ambiguity in, for example, a linear array.

For a better understanding of the present invention and to show how it may be carried into effect, reference shall now be made by way of example to the accompanying drawings, in which.

Figure 1:
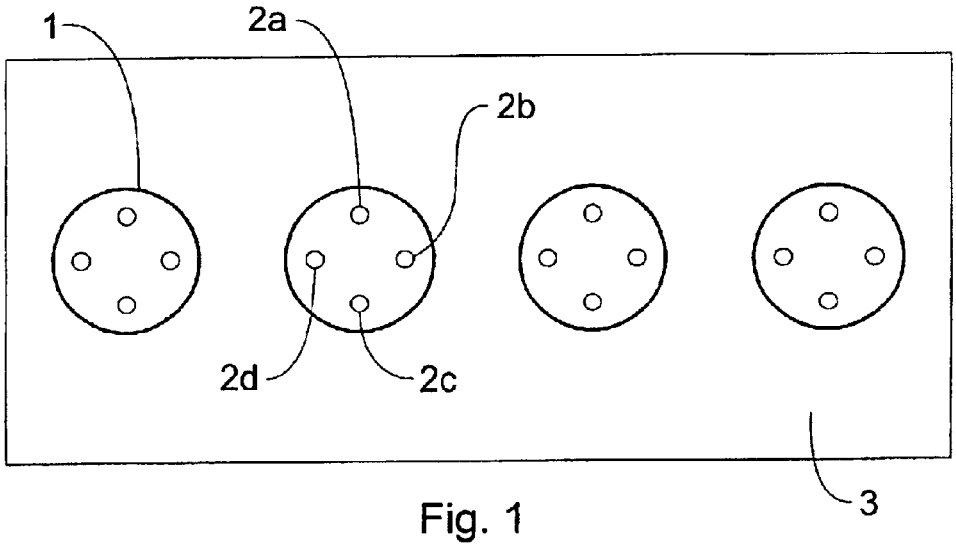
FIG. 1 shows a linear array of four steerable DRA elements, spaced λ/2 apart at the nominal working frequency of 1325 MHz.

FIG. 1 shows an antenna array composed of four DRA elements 1, each of which is fitted with four internal probes 2*a*, 2*b*, 2*c*, 2*d* and mounted on a grounded substrate 3. The spacing of the array elements 1 is a half of a wavelength. Antenna pattern steering is achieved using power splitter/combiners (not shown) and cable (not shown) delays to drive the elements. Element pattern steering is achieved by switching between probes 2, or by using power splitter/combiners to drive two probes 2 simultaneously.

Each DRA element 1, when excited in a preferred $HEM_{11\delta}$mode, which is a hybrid electromagnetic resonance mode radiating like a horizontal magnetic dipole, gives rise to a vertically polarised radiation pattern with a cosine or figure-of-eight shaped pattern.

Figure 2:
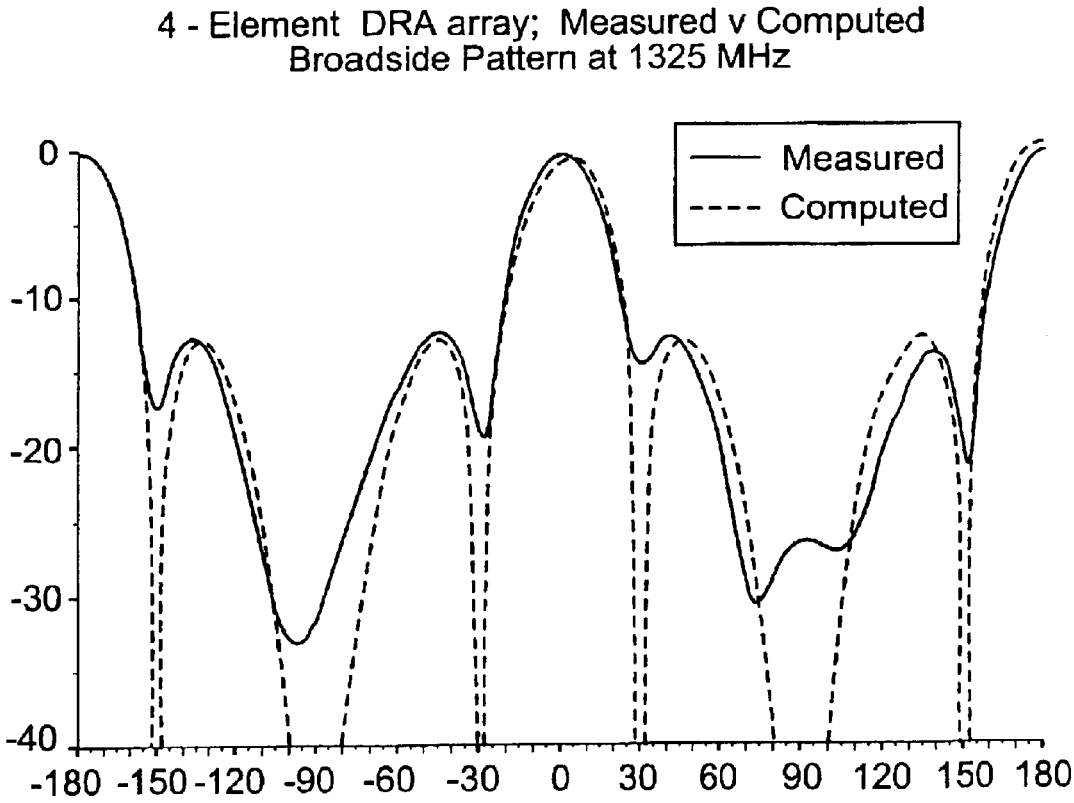
FIG. 2 shows a comparison of measured and computed broadside (boresight) patterns for the array of FIG. 1.

When a broadside (boresight) antenna pattern is formed using one probe 2 in each element 1 (in this case, the upper probe 2*a* in each DRA element 1 of FIG. 1), the pattern produced is substantially as predicted by theory, as shown in FIG. 2.

Figure 3:
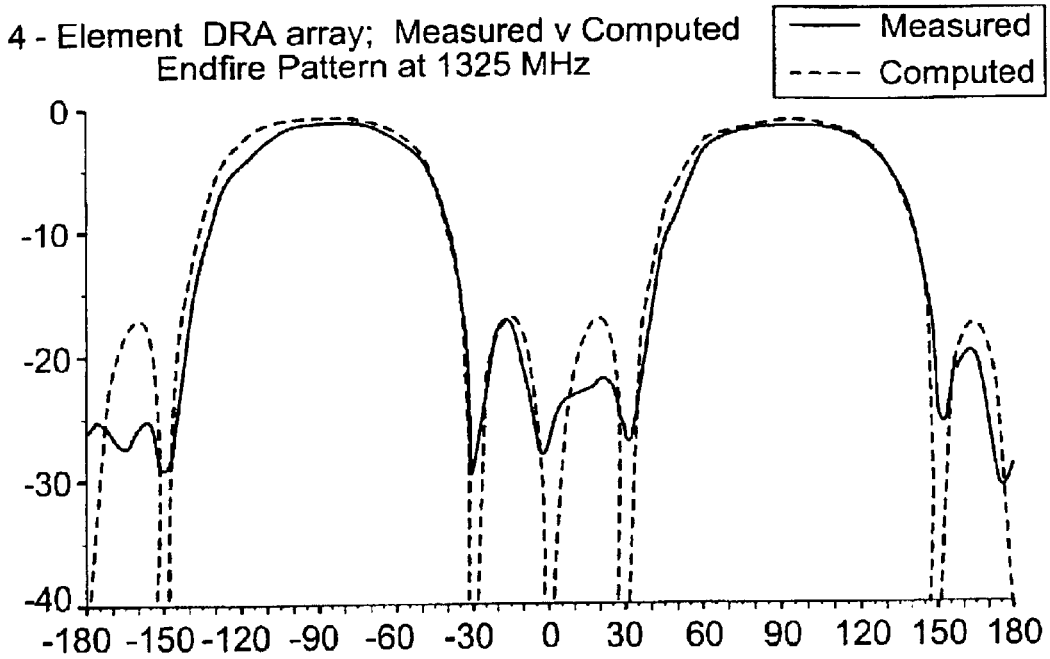
FIG. 3 shows a comparison of measured and computed end-fire patterns for the array of FIG. 1.

The array of FIG. 1 is also capable of operating in end-fire mode by switching to the probe 2*b* in each DRA element 1, which is internally disposed at 90 degrees to the probe 2*a* used for broadside operation. Again, the agreement with theory is excellent, as can be seen in FIG. 3. Switching probes to allow the array to end-fire is an important facility as it enables the array to steer through 360 degrees. When the opposite internal DRA probes are used to end-fire in the opposite direction, a pattern almost identical to FIG. 3 is obtained, except with a left-right reverse.

Figure 4:
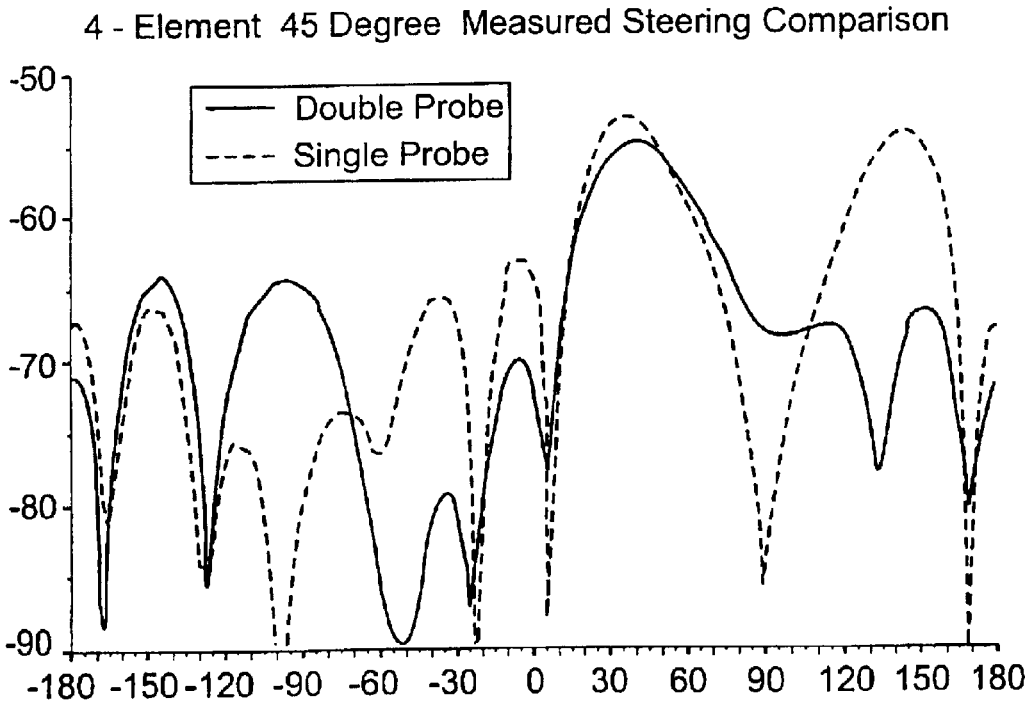
FIG. 4 shows a comparison of single and double feed activation of the array elements of FIG. 1 for an array factor steered in one direction from broadside.

The array factor may be steered by inserting cable delays in the feeds to each probe 2 in each element 1. FIG. 4 shows the result of steering the antenna pattern by a nominal 41.5 degrees in a given direction from broadside in azimuth (the aim was a steering angle of 45 degrees, but the cables available prevented this being achieved exactly). Initially, the probes 2*a* used to form the broadside pattern were used—this represents the usual case for an array when no element steering is available. Also shown in FIG. 4 are the measured patterns when two probes 2*a*, 2*b* are used in each DRA element 1 to steer the element pattern to roughly 45 degrees. The increase in array gain caused by steering the elements 1 in synchronism with the array pattern is clearly apparent. It should also be noted that in the two-probe case, there is an additional loss in the power splitters of about 1 dB, so the actual effect is better than displayed in FIG. 4. It can also be seen that there is a dramatic improvement in the antenna pattern in that a large sidelobe at around 140 degrees has been significantly reduced. This illustrates a further benefit of element beamsteering.

Figure 5:
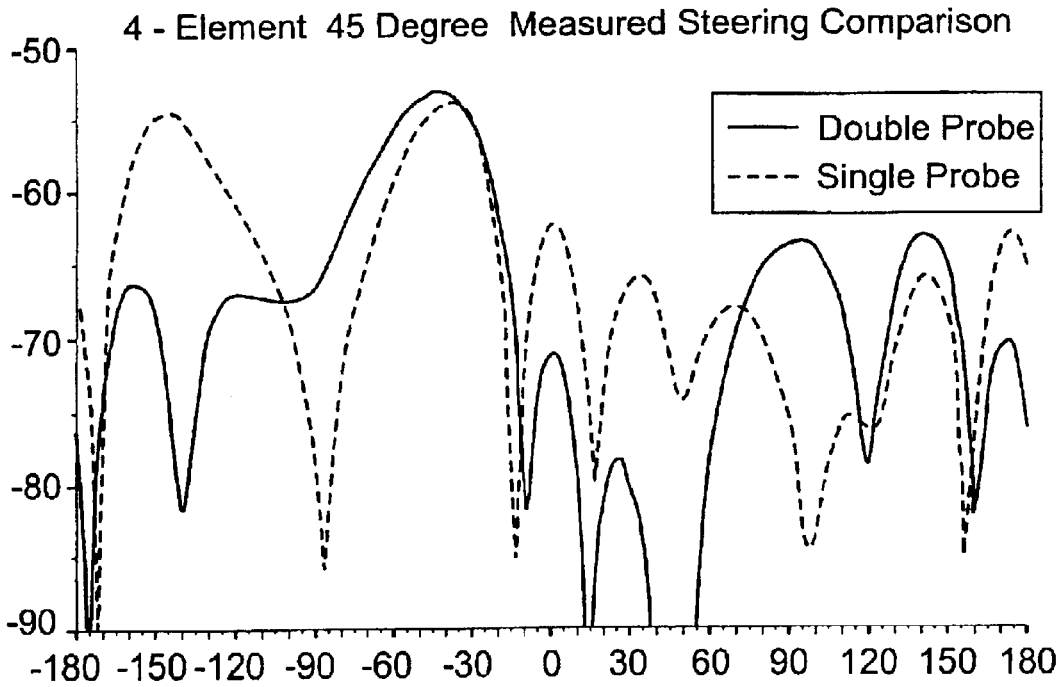
FIG. 5 shows a comparison of single and double feed activation of the array elements of FIG. 1 for an array factor steered in the opposite direction from broadside to FIG. 4.

The results for steering about 45 degrees to the other side of broadside are shown in FIG. 5. It can be seen that the results are almost a 'mirror image' of those shown in FIG. 4, and that the increase in gain and main sidelobe reduction arising from element steering is again achieved.

The benefits of gain recovery by element beam steering are determined by measuring the S12 transmission loss between the terminals of a network analyser being used to measure the antenna patterns. These can be summarised as follows:

| Pattern | Expected | Measured |
|---|---|---|
| S12 transmission loss of broadside pattern | −52.1 dB | −52.1 dB |
| S12 transmission loss of 45° pattern, single probe | −54.8 dB | −54.9 dB |
| S12 transmission loss of 45° pattern, two probes | −53.8 dB | −53.9 dB |

Normalising these results:

| Pattern | Expected | Measured |
|---|---|---|
| Normalised broadside gain (reference) | 0.0 dB | 0.0 dB |
| Array steered to 45° (0.2 dB cable loss subtracted) | −2.5 dB | −2.6 dB |
| Array & elements to 45° (1.0 dB splitter loss subtracted) | −0.0 dB | −0.6 dB |

When the array only is steered to 45°, the gain on boresight is expected to drop by 2.5 dB due to the cosine pattern of the elements 1. The measured result is within 0.1 dB of this result at −2.6 dB. Cable losses have been removed from the reading. When the elements 1 are also steered to 45°, the gain should theoretically return to close to that of broadside. The measured result is within 0.6 dB of this value, the discrepancy mainly being due to the difference between the actual steering to 41.5° and the nominal steering to 45°.

Figure 6:
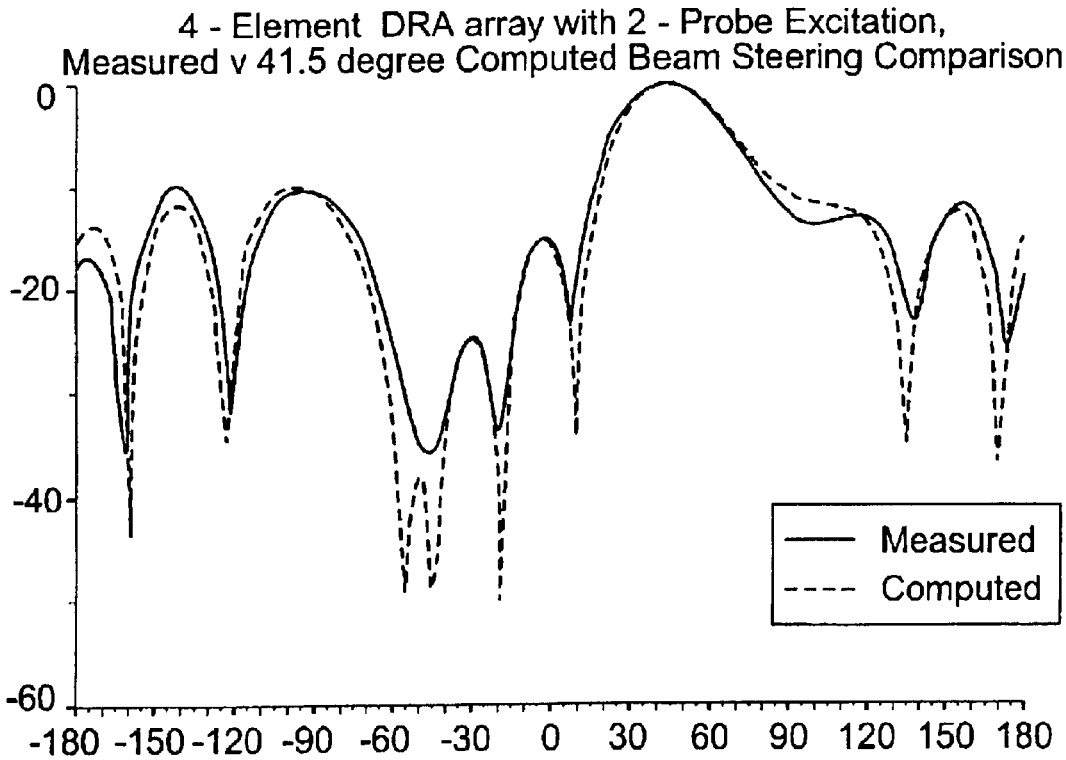
FIG. 6 shows a comparison of theoretical and measured patterns for the array of FIG. 1 steered to roughly 45 degrees.

In order to test whether the two probes steered pattern is as expected, the theoretical two probes computed pattern is compared with the measured two probes pattern of FIG. 4. The results, plotted in FIG. 6, show that the agreement between measurement and theory remains excellent.

Figure 7:
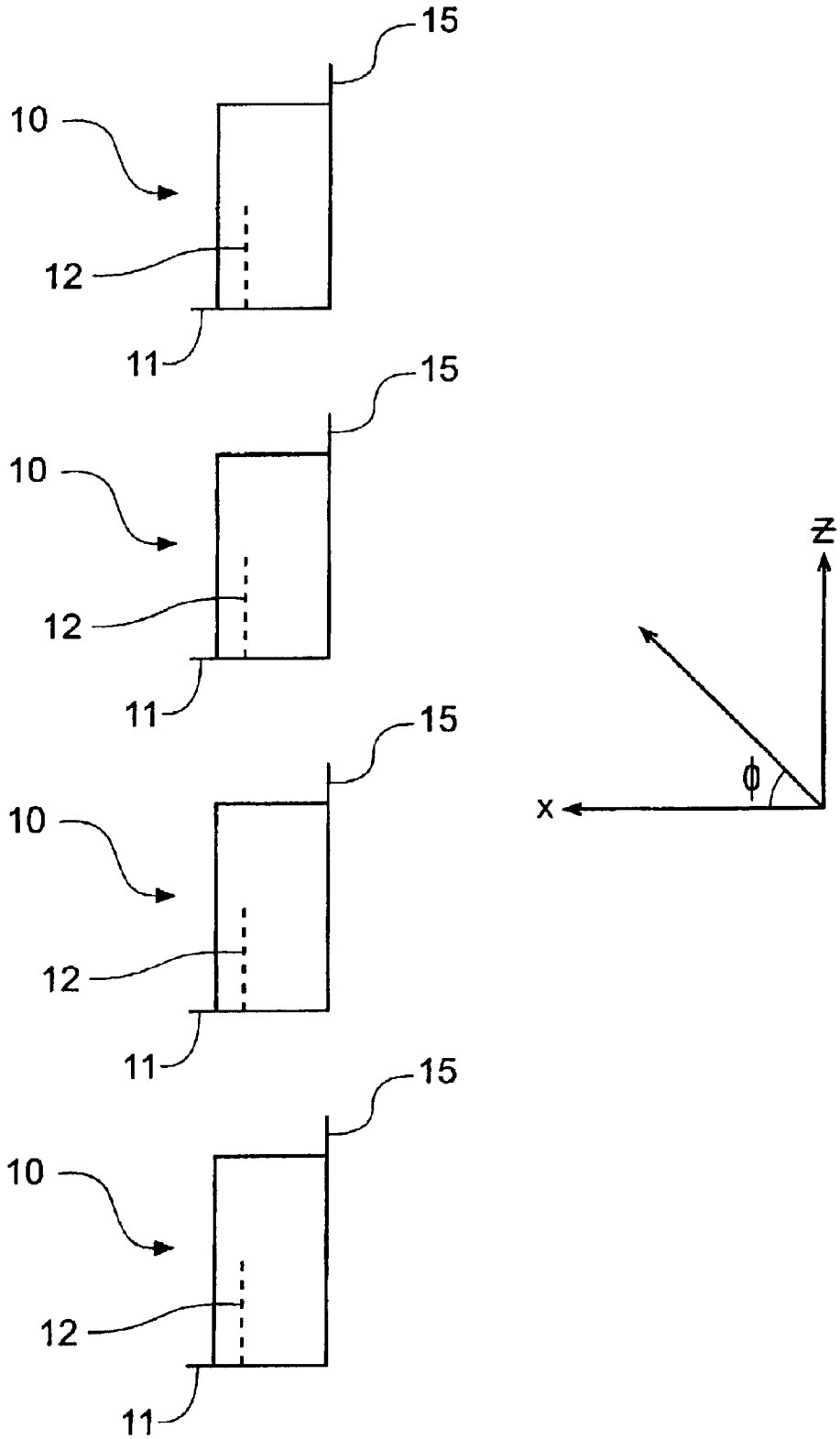
FIG. 7 shows a schematic view of a first array of four multi-segmented compound DRAs stacked on top of each other in a vertical configuration.
Figure 8:
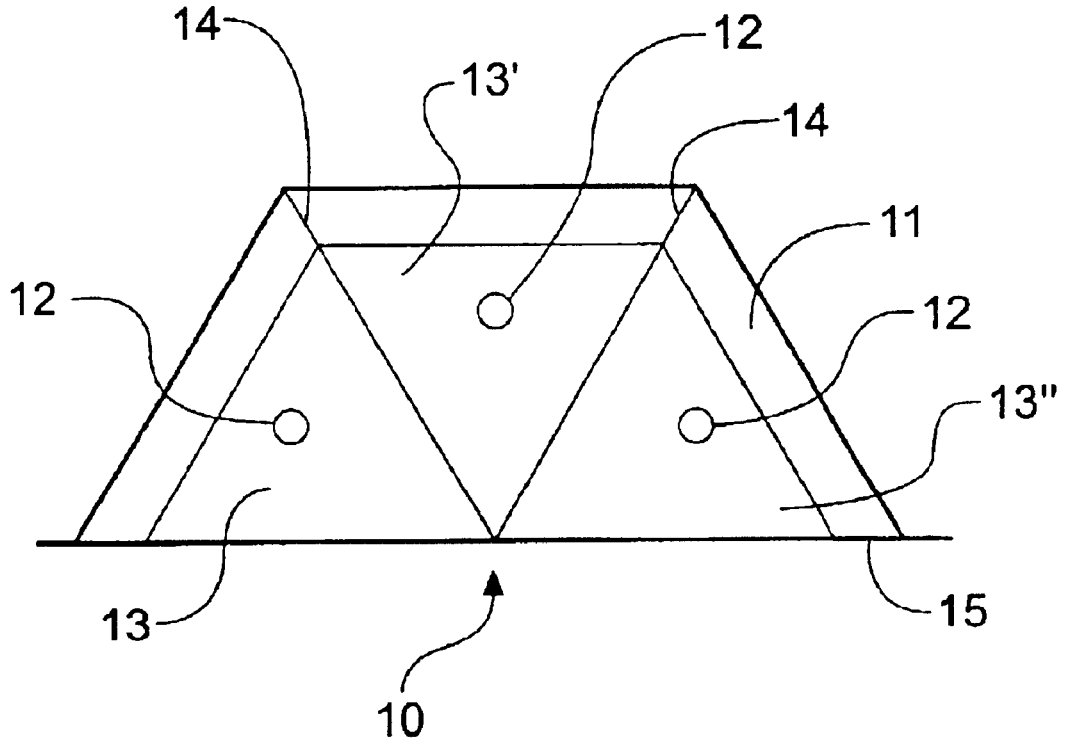
FIG. 8 shows a plan view of one of the multi-segmented compound DRAs of FIG. 7.

FIG. 7 shows a vertically-stacked array of multi-segmented compound DRA elements 10 each being disposed on a grounded substrate 11 and having a plurality of feeds 12 for transferring energy into and from the DRAs 10. As shown in FIG. 8, each multi-segmented compound DRA 10 comprises three generally trapezoidal dielectric resonators 13, 13', 13" arranged on the grounded substrate 11 in a generally semi-hexagonal configuration, with adjacent side faces of the dielectric resonators 13, 13', 13"being separated from each other by a conductive wall 14. A conductive backplate 15 is provided behind each DRA 10 as shown best in FIG. 8. Each dielectric resonator 13, 13', 13"includes a monopole feed probe 12, and the feed probes 12 may be activated either individually or in combination by way of electronic circuitry (not shown) connected thereto so as to generate at least one incrementally or continuously steerable beam which may be steered through a predetermined angle $\alpha$ in azimuth.

When four such DRA elements 10 are disposed as elements of a vertical array as shown in FIG. 7 and activated appropriately by way of the feed probes 12, a resultant beam can be generated which may be steered in elevation $\Phi$ as well as in azimuth $\alpha$. The DRAs 10 are vertically separated by a nominal spacing of $\lambda/2$, where $\lambda$ is the wavelength of the generated beam. In the present example, no weighting or window function has been applied, and therefore sidelobe levels are expected to be high. Sidelobes may be improved by increasing the number of DRAs 10 in the array and also by applying a weighting/window function. The return loss for each DRA 10 in the present example is better than −20 dB.

Figure 9:
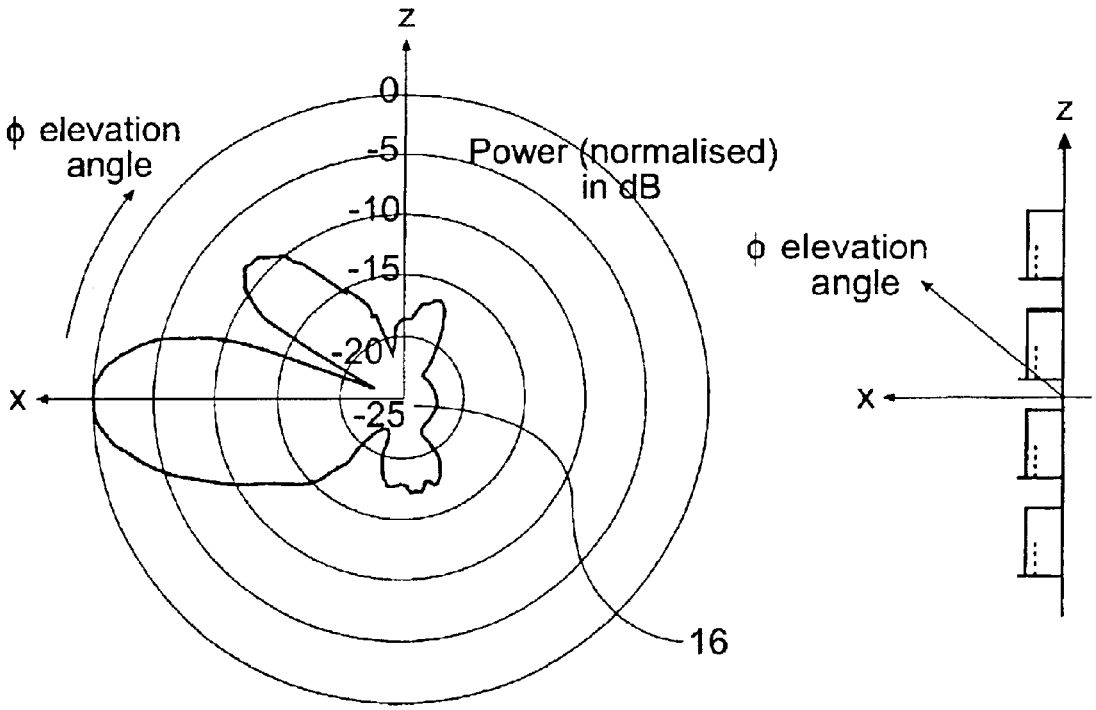
FIG. 9 shows an elevation pattern for the array of FIG. 7.

Referring now to FIG. 9, this shows the elevation pattern for the array of FIGS. 7 and 8 with only the central dielectric resonator 13' of each DRA 10 being activated. The vertical beamwidth is determined by the 4-element array factor and is around 25° at the −3 dB level. The backlobe 16 is determined to some extent by the size of the backplate 15, and in the present example is around −27 dB.

The length of the conductive walls 14 separating the dielectric resonators 13, 13', 13" can help to determine the azimuth pattern beamwidth. Short walls 14 which do not project significantly beyond the dielectric resonators 13, 13', 13" of the DRA 10 tend to give element beamwidths of around 90°. Longer walls 14 which project further beyond the dielectric resonators 13, 13', 13" can bring this beamwidth down to 40°. The array factor beamwidths are almost identical to the element beamwidths, as expected.

Figure 10:
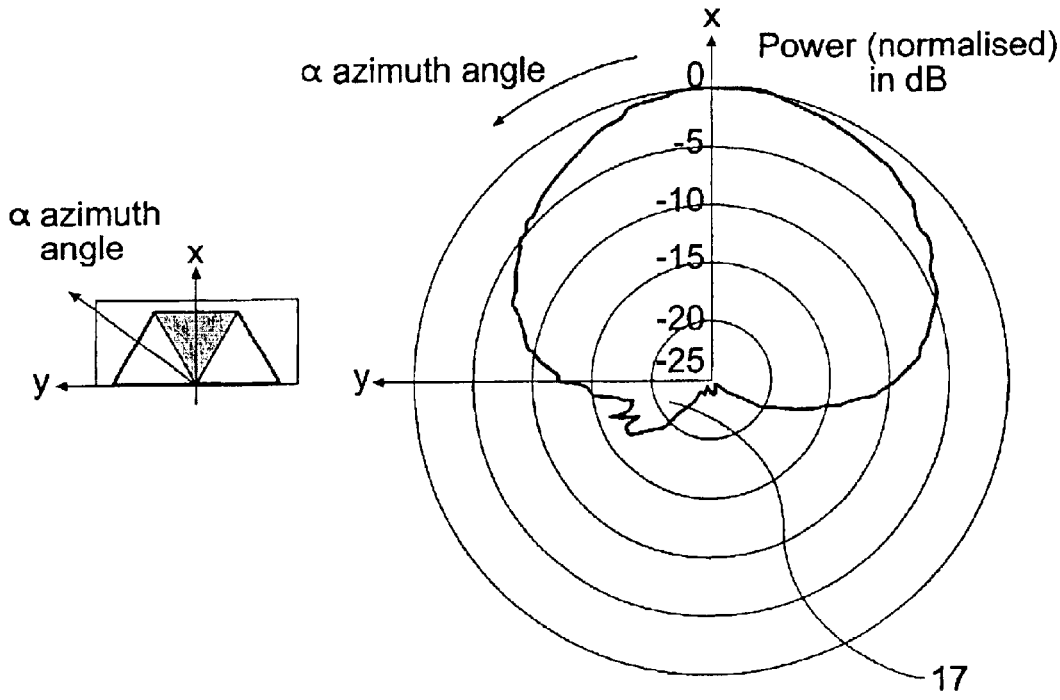
FIG. 10 shows a first azimuth pattern for the array of FIG. 7.
Figure 11:
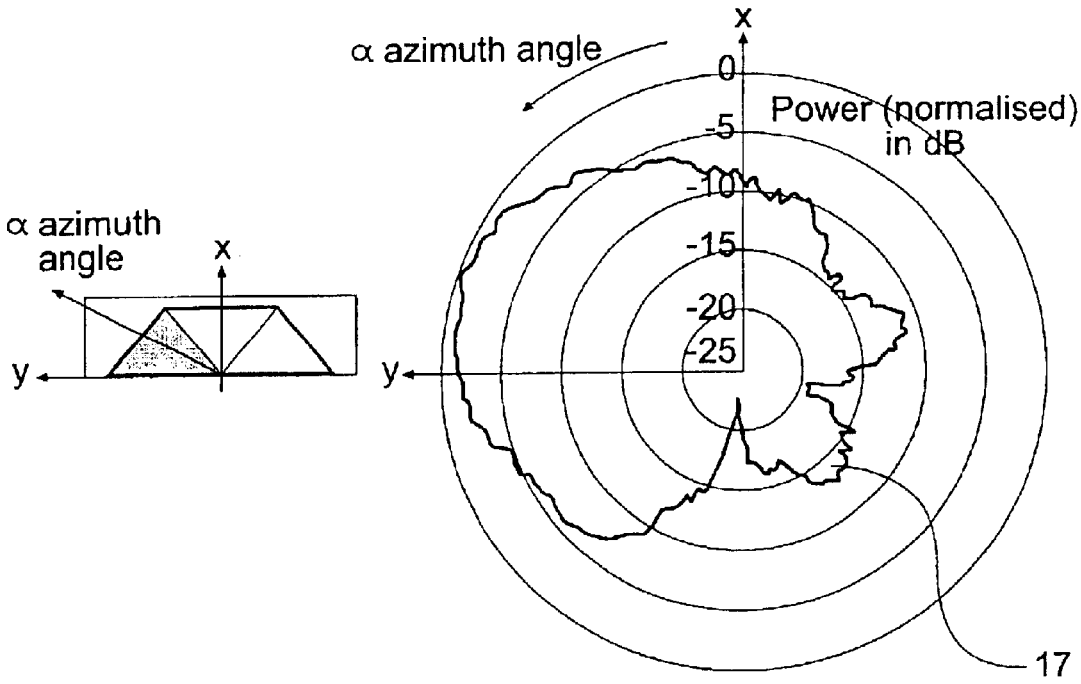
FIG. 11 shows a second azimuth pattern for the array of FIG. 7.

FIG. 10 shows the measured azimuth pattern for the array of FIGS. 7 and 8 with the central dielectric resonator 13' of each DRA 10 being activated. DRAs 10 with short walls 14 projecting only just beyond the dielectric resonators 13, 13', 13" were used, and the beamwidth is therefore around 90°. The backlobe 17 is of the same order as before, that is, around −25 dB FIG. 11 shows the measured azimuth pattern for the array of FIGS. 7 and 8 with the left-hand dielectric resonators 13 of each DRA 10 being activated. It can be seen that the array factor has been steered by around 75°, and that the backlobe 17 is worse than in FIG. 10, being around −13 dB.

The array of FIGS. 7 and 8 may be used as a base station antenna for a GSM mobile communications network, with beamsteering in both azimuth and elevation. The elevation pattern is controlled by the array factor of the array, and the azimuth pattern by feeding the dielectric resonators 13, 13', 13" in each DRA 10 in various combinations or individually and also by selecting appropriate lengths for the conducting walls 14. Such a base station antenna may be engineered to specifications for a conventional second generation GSM system. The antenna may be roughly 10 cm wide, 80 cm high and 5 cm deep, and can be operated so as to generate three independent azimuth beams (which could be combined and steered, or used for direction finding), each one of which may have a 10–15° elevation pattern. Each beam may be used on a separate frequency within a 160 MHz band. By using appropriate ceramics as a material for the dielectric resonators 13, 13', 13", low losses may be achieved.

Figure 12:
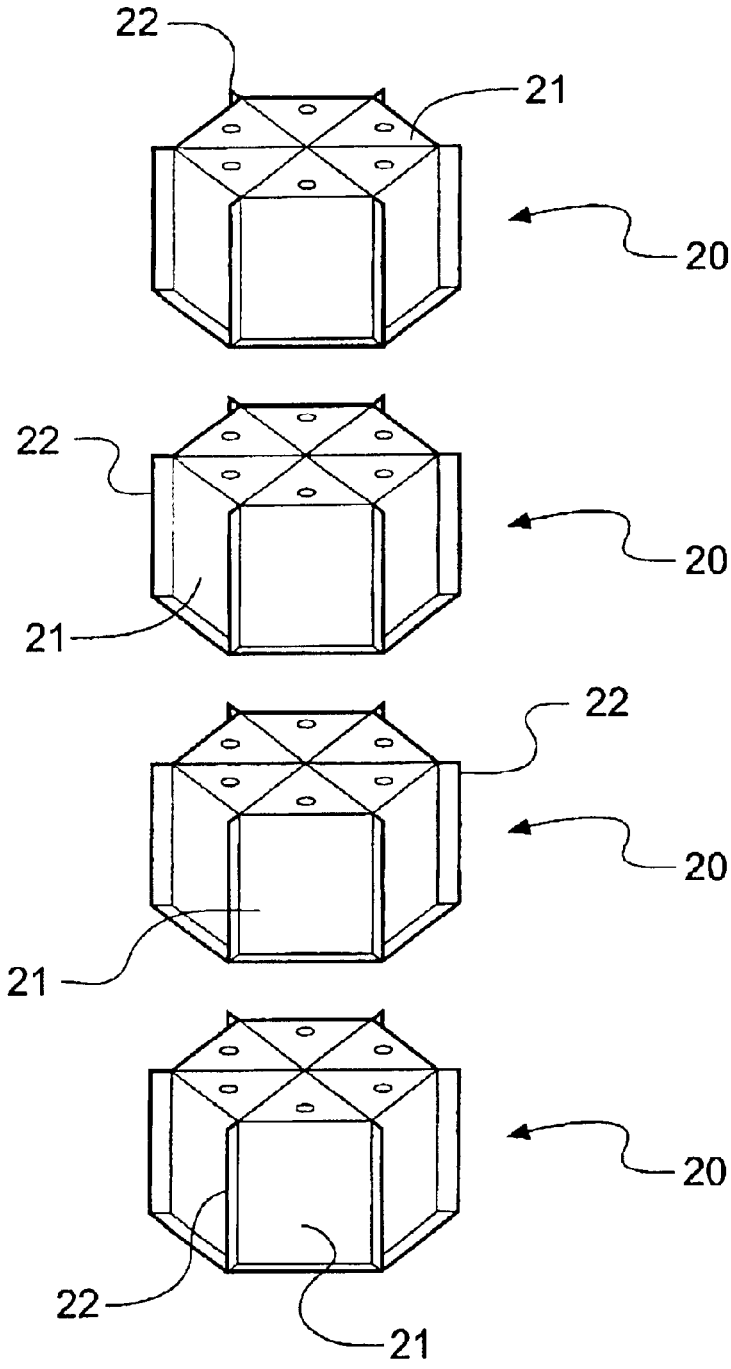
FIG. 12 shows a schematic view of a second array of four multi-segmented compound DRAs stacked on top of each other in a vertical configuration.

For full 360° beamsteering in azimuth, an array of four DRAs 20 each composed of six trapezoidal dielectric resonators 21 arranged in a hexagonal configuration and separated by conductive walls 22 may be used, as shown in FIG. 12.

What is claimed is:

1. An array of dielectric resonator antenna elements, each element having a longitudinal axis and being composed of at least one dielectric resonator and a plurality of feeds for transferring energy into and from the elements, wherein the feeds of each element are activatable either individually or in combination so as to produce at least one incrementally or continuously steerable element beam which is steered in azimuth through a predetermined angle about the longitudinal axis of the element, wherein the elements are disposed side-by-side such that their respective longitudinal axes are also disposed side-by-side, wherein during operation of the array, the feeds of the elements are activated such that the element beams from the different elements are steered in synchrony with each other, and wherein the element beams, when combined, interact so as to form at least one array beam which is steered in synchrony with the element beams.

2. An array as claimed in claim 1, further provided with electronic circuitry adapted to activate the feeds either individually or in combination so as to produce at least one incrementally or continuously steerable element beam which may be steered through a predetermined angle.

3. An array as claimed in claim 1, wherein each dielectric resonator is associated with a grounded substrate.

4. An array as claimed in claim 1, wherein the elements are disposed in a substantially linear formation.

5. An array as claimed in claim 4, wherein the elements are disposed one above the other.

6. An array as claimed in claim 4, wherein the linear formation is conformal to a curved or distorted surface.

7. An array as claimed in claim 1, wherein the elements are disposed in a ring-like formation.

8. An array as claimed in claim 7, wherein the elements are disposed in a substantially circular formation.

9. An array as claimed in claim 1, wherein the elements are disposed in at least two dimensions across a surface.

10. An array as claimed in claim 9, wherein the elements are arranged in the form of a lattice.

11. An array as claimed in claim 9, wherein the surface is conformal to a curved or distorted surface.

12. An array as claimed in claim 1, wherein the elements are arranged as a three-dimensional volumetric array.

13. An array as claimed in claim 12, wherein the volumetric array has an outer envelope substantially in the form of a regular solid selected from the group comprising sphere, tetrahedron, cube, octahedron, dodecahedron and icosahedron.

14. An array as claimed in claim 12, wherein the volumetric array has an outer envelope substantially in the form of a polyhedral solid.

15. An array as claimed in claim 12, wherein the volumetric array has an outer envelope in the form of an irregular solid.

16. An array as claimed in claim 12, wherein the volumetric array is formed as a combination of linear and/or surface arrays disposed one above the other.

17. An array as claimed in claim 1, wherein the elements are regularly spaced from each other.

18. An array as claimed in claim 1, wherein the elements are irregularly spaced from each other.

19. An array as claimed in claim 1, further including a dielectric lens which serves to control at least one beam.

20. An array as claimed in claim 1, further provided with electronic circuitry adapted to activate each of the elements with a pre-determined phase shift or time delay so as to generate an array beam pattern which may be steered through a predetermined angle.

21. An array as claimed in claim 1, further provided with electronic circuitry to combine the feeds of at least some of the elements such that a generated element beam pattern is steerable in angle in synchronism with a generated array beam pattern.

22. An array as claimed in claim 1, further provided with electronic circuitry to provide at least two feeds to each individual element such that, when the array is used to form at least two array beams simultaneously so as to form an antenna beam pattern having at least two main lobes, the elements are activatable so as to form at least two element beams simultaneously which are steerable in angle in synchronism with the antenna beam pattern.

23. An array as claimed in claim 6, further provided with electronic circuitry to activate the feeds either individually or in combination such that the elements generate element beams which all point in the same direction regardless of the shape of the curved or distorted surface.

24. An array as claimed in claim 1, wherein the feeds are adapted to provide predetermined time delays in the feed to each element.

25. An array as claimed in claim 24, wherein the feeds are connected to electrical cables, fibre optic cables, printed circuit tracks or any other transmission lines, each of which having an effective length which may be varied so as to provide different time delays in the feeds to the elements.

26. An array as claimed in claim 25, wherein the effective lengths of the transmission lines are varied by electronically switching in or out additional lengths of transmission line.

27. An array as claimed in claim 25, wherein the effective lengths of the transmission lines are varied by electrically switching in or out additional lengths of transmission line.

28. An array as claimed in claim 25, wherein the effective lengths of the transmission lines are varied by mechanically switching in or out additional lengths of transmission line.

29. An array as claimed in claim 1, wherein the feeds are provided with means for individually adjusting a phase of an energy signal carried therealong to each element.

30. An array as claimed in claim 29, wherein the phase-adjusting means are diode phase shifters, ferrite phase shifters or any other types of phase shifters.

31. An array as claimed in claim 1, wherein each element is connected to a separate transmitter or receiver module and wherein each transmitter or receiver module is controlled by any means, e.g. a computer, to generate predetermined phase and/or amplitude modifications to signals fed to or received from the elements so as to enable steering of an array beam pattern.

32. An array as claimed in claim 1, wherein the steerable element beam may be steered through a complete 360 degree circle.

33. An array as claimed in claim 1, further including electronic circuitry to combine the feeding mechanisms of multiple elements so as to form sum and difference patterns to permit radio direction finding capability of up to 360 degrees.

34. An array as claimed in claim 1, further including electronic circuitry to combine the feeding mechanisms of multiple elements to form an amplitude and/or phase comparison radio direction finding capability of up to 360 degrees.

35. An array as claimed in claim 1, wherein the feeding mechanisms take the form of conductive probes which are contained within or against the dielectric resonator elements, or a combination thereof.

36. An array as claimed in claim 2, wherein the feeding mechanisms take the form of apertures provided in the grounded substrate.

37. An array as claimed in claim 36, wherein the apertures are formed as discontinuities in the grounded substrate underneath the dielectric resonator elements.

38. An array as claimed in claim 37, wherein the apertures are generally rectangular in shape.

39. An array as claimed in claim 36, wherein a microstrip transmission line is located beneath each aperture to be excited.

40. An array as claimed in claim 39, wherein the microstrip transmission line is printed on a side of the substrate remote from the dielectric resonator elements.

41. An array as claimed in claim 35, wherein a predetermined number of the probes within or against the dielectric resonator elements, or a combination thereof, are not connected to the electronic circuitry.

42. An array as claimed in claim 41, wherein the probes are unterminated (open circuit).

43. An array as claimed in claim 41, wherein the probes are terminated by a load of any impedance, including a short circuit.

44. An array as claimed in claim 1, wherein the dielectric resonator elements are formed of a dielectric material having a dielectric constant $k \geqq 10$.

45. An array as claimed in claim 1, wherein the dielectric resonator elements are formed of a dielectric material having a dielectric constant $k \geqq 50$.

46. An array as claimed in claim 1, wherein the dielectric resonator elements are formed of a dielectric material having a dielectric constant $k \geqq 100$.

47. An array as claimed in claim 1, wherein the dielectric resonator elements are formed from a liquid or gel material.

48. An array as claimed in claim 1, wherein the dielectric resonator elements are formed from a solid material.

49. An array as claimed in claim 1, wherein the dielectric resonator elements are formed from a gaseous material.

50. An array as claimed in claim 1, wherein a single transmitter or receiver is connected to a plurality of elements.

51. An array as claimed in claim 1, wherein a plurality of transmitters or receivers are individually connected to a corresponding plurality of elements.

52. An array as claimed in claim 1, wherein a single transmitter or receiver is connected to a plurality of non-adjacent elements.

53. An array as claimed in claim 1, wherein each element is a compound dielectric resonator antenna comprising a plurality of individual dielectric resonator antennas each including a dielectric resonator having side faces, and a feeding mechanism for transferring energy into and from the dielectric resonator, wherein the dielectric resonators are arranged such that at least one side face of each dielectric resonator is adjacent to at least one side face of a neighbouring dielectric resonator.

54. An array as claimed in claim 53, wherein a gap is provided between at least two of the adjacent side faces.

55. An antenna as claimed in claim 53, wherein the adjacent side faces of at least one pair of neighbouring dielectric resonators are separated by an electrically conductive wall which contacts both side faces.

56. An antenna, as claimed in claim 1, wherein:

each of the antenna elements are spaced no greater than a half-wavelength apart.

57. A method of steering beams of an array of antenna elements, said method comprising the steps of:

providing an array of antenna elements arranged side-by-side and each having respective longitudinal axes also disposed side-by-side, each antenna element further including at least one dielectric resonator, and a plurality of feeds for transferring energy into and from each antenna element;

activating feeds of each antenna element individually, or in combination, to produce a corresponding steerable element beam from each antenna element; and steering the element beams through a predetermined angle wherein each element beam moves in synchrony with the other element beams and about their respective longitudinal axes.

58. A method, as claimed in claim 57, wherein:

each of the antenna elements are further disposed one above the other.

59. A method, as claimed in claim 57, wherein:

each of the antenna elements are spaced no greater than a half-wavelength apart.

* * * * *